US007488002B2

(12) United States Patent
Ahlers et al.

(10) Patent No.: US 7,488,002 B2
(45) Date of Patent: Feb. 10, 2009

(54) SECURITY AND/OR VALUE DOCUMENT

(75) Inventors: Benedikt H. Ahlers, Berlin (DE); Frank Kappe, Rheda-Wiedenbrückq (DE); Roland Gutmann, Falkensee (DE); Ralf Paugstadt, Berlin (DE); Armim Franz-Burgholz, Falkensee (DE)

(73) Assignee: Securency Pty Limited, Craigieburn (AU)

( * ) Notice: Subject to any disclaimer, the term of this patent is extended or adjusted under 35 U.S.C. 154(b) by 349 days.

(21) Appl. No.: 10/740,751

(22) Filed: Dec. 22, 2003

(65) Prior Publication Data

US 2005/0057036 A1 Mar. 17, 2005

Related U.S. Application Data

(63) Continuation of application No. 10/060,372, filed on Feb. 1, 2002, now abandoned, which is a continuation of application No. 09/476,203, filed on Jan. 3, 2000, now abandoned, which is a continuation of application No. PCT/DE98/01900, filed on Jul. 2, 1998, now abandoned.

(51) Int. Cl.
*B42D 15/00* (2006.01)

(52) U.S. Cl. ..... 283/72; 283/73; 283/91; 283/901

(58) Field of Classification Search ..... 283/72, 283/73, 82, 91, 111, 107, 901; 428/611; 206/775, 776, 807; 235/379
See application file for complete search history.

(56) References Cited

U.S. PATENT DOCUMENTS 3,227,474 A 1/1966 Hoeflinger
3,827,726 A 8/1974 McVoy et al.
3,961,956 A 6/1976 Fukuda et al.
4,100,689 A 7/1978 Broune
4,417,784 A 11/1983 Knop et al.
4,536,016 A * 8/1985 Solomon et al. ..... 283/111
4,668,597 A 5/1987 Merchant
4,953,949 A 9/1990 Dallas
4,984,824 A 1/1991 Antes et al.
5,033,829 A 7/1991 Faroughy
5,059,776 A 10/1991 Antes
5,082,337 A 1/1992 Chern et al.
5,153,670 A 10/1992 Jannson et al.

(Continued)

FOREIGN PATENT DOCUMENTS

AU 45319/68 4/1970

(Continued)

OTHER PUBLICATIONS

"New 10-Dollar Bnk Note" announcement, Jan. 1988 (German w/English translation).

(Continued)

*Primary Examiner*—Willmon Fridie, Jr.
(74) *Attorney, Agent, or Firm*—Christensen O'Connor Johnson Kindness PLLC

(57) ABSTRACT

Security and/or value document, with security features and with a verification element for verifying the security feature is disclosed. Integrated into the security and/or value document at different positions is at least one verification element and at least one security feature to be verified by the verification element. When the verification element and the security feature are only superimposed, verification takes place.

73 Claims, 4 Drawing Sheets

U.S. PATENT DOCUMENTS

| | | | | |
|---|---|---|---|---|
| 5,246,375 | A | 9/1993 | Goede | |
| 5,267,060 | A | 11/1993 | Colton | |
| 5,284,364 | A | 2/1994 | Jain | |
| 5,321,755 | A | 6/1994 | Vlaar | |
| 5,393,099 | A | 2/1995 | D'Amato | |
| 5,396,559 | A | 3/1995 | McGrew | |
| 5,445,417 | A | 8/1995 | Bromer et al. | |
| 5,526,145 | A | 6/1996 | Weber | |
| 5,995,638 | A | 11/1999 | Amidror et al. | |
| 6,062,604 | A | 5/2000 | Taylor et al. | |
| 6,089,614 | A * | 7/2000 | Howland et al. | 283/91 |
| 6,210,777 | B1 * | 4/2001 | Vermeulen et al. | 428/195.1 |
| 6,273,473 | B1 | 8/2001 | Taylor et al. | |
| 6,428,051 | B1 | 8/2002 | Herrman et al. | |
| 6,471,247 | B1 | 10/2002 | Hardwick et al. | |

FOREIGN PATENT DOCUMENTS

| | | | |
|---|---|---|---|
| AU | 488652 | | 4/1976 |
| AU | 87665/82 | | 4/1983 |
| CA | 2032587 | C | 6/1991 |
| CA | 2162683 | A1 | 11/1994 |
| DE | 3208204 | | 9/1983 |
| DE | 34 45 973 | | 6/1986 |
| EP | 0036298 | A1 | 9/1981 |
| EP | 0 059 056 | A1 | 8/1982 |
| EP | 0256176 | A1 | 2/1988 |
| EP | 0290875 | A2 | 11/1988 |
| EP | 0 330 738 | B1 | 9/1989 |
| EP | 0373820 | A3 | 6/1990 |
| EP | 0 388 090 | A1 | 9/1990 |
| GB | 1151772 | | 5/1969 |
| GB | 1167519 | | 10/1969 |
| GB | 1407065 | | 9/1975 |
| GB | 1512018 | | 5/1978 |
| GB | 2172850 | A | 3/1985 |
| GB | 2224240 | A | 11/1991 |
| GB | 2250473 | A | 6/1992 |
| GB | 2289016 | A | 11/1995 |
| WO | WO 83/00659 | A1 | 3/1983 |
| WO | WO 90/15367 | A2 | 12/1990 |
| WO | WO 94/02329 | A1 | 2/1994 |
| WO | WO 94/27254 | A1 | 11/1994 |
| WO | WO 95/04665 | A1 | 2/1995 |
| WO | WO 95/10420 | A1 | 4/1995 |
| WO | WO 95/30972 | A1 | 11/1995 |
| WO | WO 97/01156 | A1 | 1/1997 |
| WO | WO 98/13211 | A1 | 4/1998 |
| WO | WO 98/15418 | | 4/1998 |
| WO | WO 98/15418 | A1 | 4/1998 |
| WO | WO 03/086775 | A1 | 10/2003 |

OTHER PUBLICATIONS

Bergmann-Schaefer, "Lehrbuch der Experimentalphysik, Band 111," *Optik,* H. Gobrecht, pp. 229-312, 1974 (German/no translation).

Dobrowolski, J.A., et al., "Optical Interference Coatings for Inhibiting of Counterfeiting," *Optica Acta,* vol. 20, No. 12, 1973, pp. 925-937.

Garoffolo, B., and R. Gration, "New Standards for Banknote Security-Polymer Banknotes," article, Note Printing Australia.

Internet-Auszug "Holographie" <www.unet.univie.ac.at/~a9001783/SAFEDIPL/node7.html> (definition of "holography" in German/no translation) [retrieved Feb. 6, 2000].

Internet-Auszug "Interferenzfilter" <www.online-miesel.de/lexikon/interferenzfilter.html> (definition of "interference filter" in German/no translation), n.d.

Internet-Auszug "Interferenz-filter" aus Wikipedia, der freien Enzyklopadie, <de.wikipedia.org/wiki/interferenzfilter> (definition of "interference filter" in German/no translation), n.d.

van Renesse, Rudolf L., *Optical Document Security,* Verlag Artech House, Inc., 1994, pp. 89 and 144.

* cited by examiner

SECURITY AND/OR VALUE DOCUMENT

CROSS-REFERENCE TO RELATED APPLICATIONS

This application is a continuation of U.S. patent application Ser. No. 10/060,372 filed Feb. 1, 2002, which is now abandoned and which is a continuation of U.S. patent application Ser. No. 09/476,203 filed Jan. 3, 2000, which is now abandoned and which is a continuation of International Application No. PCT/DE98/01900, filed Jul. 2, 1998, which designated the United States and is now abandoned, and which is based on German Application No. DE 197 29 918.0, filed Jul. 4, 1997, the subject matter of all of which is incorporated herein in their entirety by reference. The benefit of the filing dates of these applications is claimed under 35 U.S.C. §§ 119, 120 and 365(c) as appropriate.

FIELD OF THE INVENTION

The present invention relates to a security and/or value document with security features and a verification element for verifying the security features.

BACKGROUND OF THE INVENTION

Security and/or value documents, such as passports, banknotes, and the like, require security against forgery, preferably in a way that allows such documents to be easily inspected for authenticity without the use of external aids.

As a result, it is desirable to incorporate into these products features whereby their authenticity may be checked.

Preferably, these security features should be fixed in an inseparable manner to the product that is to be authorized and/or they should have features that are difficult to reproduce. The invention relates to the manufacture and application of security features for security documents and/or value documents.

Numerous security features are known in the art, such as fluorescent fibres or threads/planchettes/inks, microprints, moiré-generating structures, holograms and the like.

Frequently the security features implemented in products requiring protection consist of special inks having special spectral characteristics, magnetic properties or temperature-dependent behaviour (thermochromic inks). Also used are barcodes which use the difference in reflectivity of the surface. Grid structures or even foil antennae that utilize the resonant frequency of an oscillator circuit are also used.

AU 488 652 discloses security documents where the security features can be inspected by transillumination. Arranged between plastic layers is an optically varying security element viewable through a transparent window in the overlying cover layer. The particular disadvantage is that the applied security features can only be viewed by the naked eye under transillumination, and that the material properties of the document are greatly altered.

The incorporation of a single transparent window on banknotes is also known in the art in Australian banknotes.

DE 43 34 847 A1 describes a value document formed with a window-like cut-out. The window-like opening is in the base material and subsequently covered by a transparent cover film. The cover film in this part of the window can incorporate additional security features. The process of manufacturing the cut-out opening in the base material of the security or value document, to form a window, and then covering this window with a cover film that partly incorporates additional security, is technologically expensive and results in an increase in the thickness of the value document. The requirement that certain parts of the window must remain transparent so that the security features can be viewed by transillumination with the naked eye limits the possibilities of providing security features in a concealed form. Like known window threads used on banknotes, such elements per se, only serve as a security element but have no further function. These known windows may themselves also incorporate security features.

Authenticity-checking of known security elements usually requires special equipment and methods, in particular: external testing devices such as magnifying glasses for checking microprinting, lenticular screens for checking hidden graphical elements, UV lamps to make fluorescent elements visible, or optical recognition of the respective security feature using a transillumination method.

DE 36 09 090 A1 describes a security or value document into which a security thread has been incorporated, which can be viewed visually without the use of technical aids. The security thread consists of a transparent material. Impressed into the upper surface is a screen of cylindrical lenses. Applied directly to the opposite side of the foil of the thread there is a printed image. The printed image is designed with consideration to the optical characteristics of the cylindrical lenses. By suitably designing the printed image accordingly, it is possible to incorporate information that only becomes visible from certain viewing angles.

A disadvantage here is that there is paper arranged directly beneath the thread resulting in the security feature only being viewable through reflection and not through transmission. The security lies solely in the threads which is a conventional security element.

SUMMARY OF THE INVENTION

The object of the present invention is to develop a generically compliant security document and/or value document, in which security against forgery is increased and the document can be inspected for authenticity more easily and without the use of external aids.

Accordingly, the present invention provides a security and/or value document, in particular a banknote, with security features and with a verification element for verifying the security feature, characterized in that at least one verification element and at least one security feature verifiable by means of said verification element are integrated in the document at different positions, and the verification element and the security feature are only superimposed when verification takes place.

Due to the provision of both security features as well as verification means such as detectors for verifying these security features on or in a document, no external means for checking the authenticity of the document are required. The authenticity of security features on a document, for example a banknote, can be checked by means of one or more transparent windows on the same banknote. The combination of security features and a verification system on one and the same banknote increases security against forgery because the verification means can in itself also be designed as a security feature. Both the front and rear side of the banknote can be viewed to check authenticity. By suitably folding a banknote, or any other document in accordance with the invention, or by laying at least one banknote on top of another, it is possible to check the security feature by bringing the security feature into functional relation with the verification system, i.e. the window.

A verification element that has been applied to the value document can be used to check security elements incorporated at different positions in the value document.

For example, in a passport two opposing pages can be used to verify the document. One of the pages can be fitted with the verification element, e.g. a lenticular screen film, on part or all of the page, while the other page may have the security feature that is to be analysed, for example a latently visible screen structure. The authenticity of the document is checked by suitably placing these two pages over each other. Similarly, two banknotes, cheques, or two other equivalent value documents can be checked for authenticity.

Of decisive importance is the functionality of the window or windows integrated in the document. No substantial thickness is added to the document because the security feature and the detection means are located on different parts of the document and not over each other.

The preferred embodiment of the verification element as a detector/analyser or even a decoder in the form of one or more transparent windows, or as a window with two or more analyser areas with detection elements, ensures a multitude of different variations for testing the authenticity of a large number of possible security features.

The verification elements on/in one window or on/in several windows or sections of a window are preferably formed of clear, transparent material and are preferably formed out of one of the following groups:

1. The verification elements can be formed by lenticular lenses/cylindrical lenses/alternating images and autostereoscopic devices, which are located on/in a transparent film or the like and make it possible to see the optically coded security features or structures printed on the document.

The lenticular screens preferably consist of uniform cylindrical lenses, which are arranged parallel to each other, preferably at the same distance apart (e.g. 200 μm). The focus of such a lens screen is preferably matched to the optical thickness of the transparent substrate material used.

The cylindrical lenses can be made in a transparent material, e.g. PVC films, in several different ways, e.g. by imprinting with a suitable mould; or by casting the film in a suitable mould; or by extrusion, using specially formed injection nozzles.

2. The verification elements can be formed by using Fresnel lenses or other similar magnifying optical structures, which facilitate the detection of very fine print or very small graphics on the respective document.

3. The verification elements can be formed by fine graphical structures that are applied—preferably by printing—to both the film of a window as well as to part of the document.

The window can form a mask for a "parallax-barrier display".

When the corresponding surfaces (window/security feature on the document) are placed on top of each other, so-called moire structures may be generated. Together with the line or dot screens in the area of the security feature on the document, the line or dot screens on the window form such a moire structure. The moire pattern thus formed is the characteristic security feature for the value document.

If the windows are arranged in such a manner that they are placed on top of each other when the document is folded, then structures in accurate register can create colour or pattern changes when the two surfaces are moved relative to each other.

4. The verification elements can be formed as polarization filters.

In one preferred embodiment, two clear windows are arranged adjacently or a window is divided into two analyser areas.

The windows can be embodied as two polarizers for viewing polarisation stereo images.

One specially formed window can produce a "Polaroid-Vectograph".

Windows can be formed in such a way that a switch in contrast from transmitting to opaque can be implemented. Such structures can be implemented by half-wave zones applied to a linearly polarizing film. For example, by suitably oriented films of correct thickness.

The bright and dark areas of an image may be linearly polarizing areas with alternating horizontal and vertical polarising directions.

Windows can be formed, that implement a clear switch in colour based on the "colour shutter" principle.

5. The window can be embodied as an interference filter or colour filter. Transparent diffraction structures, multilayer systems are examples of interference filters.

The transparent window can be embodied as a holographic filter that reflects a narrow spectral range, either analogous to holographic laser-protection spectacles, or a compound colour appears in a different colour, or a pure spectral colour disappears.

Such a filter is also suitable for two clear windows, whereby the verification window may be subdivided into a holographic part and a non-filtering adjacent part.

The windows can be designed as two colour filters for viewing anaglyphs (stereo images) or as prisms, preferably as gradient-index prisms (superchromatic where possible) for a chromastereoscopic image.

Further advantageous embodiments of the present invention will become apparent from the dependent claims.

BRIEF DESCRIPTION OF THE DRAWINGS

The invention will now be explained in greater detail on the basis of examples of a banknote (as an example of a valuable document) represented in the drawings, in which.

DETAILED DESCRIPTION OF THE EMBODIMENTS

Figure 1:
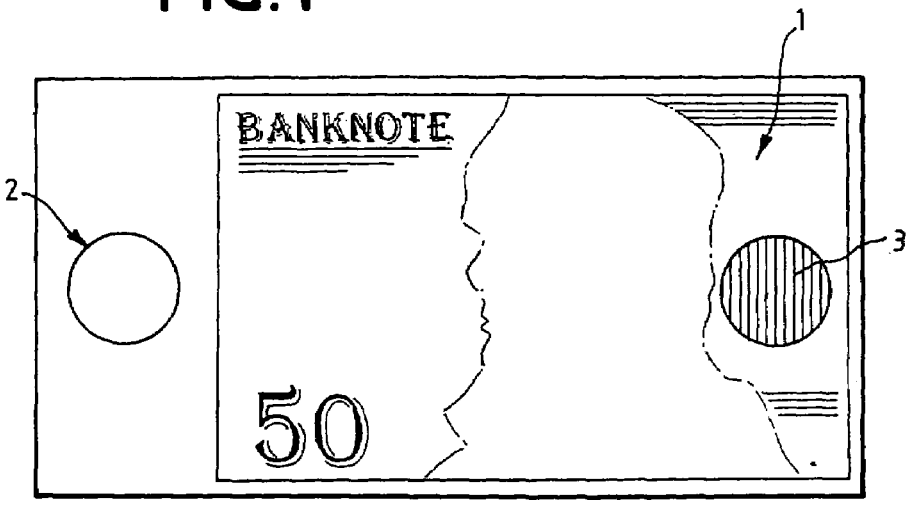
FIG. 1 is a schematic representation of a banknote with a window and a security feature.

According to the representation in FIG. 1, a value document, e.g. a banknote 1, is formed with one transparent window 2. The transparent window, which is provided with verification elements, serves as a detector or the like to verify a security feature located in zone 3 of the banknote 1. Verification of the security feature in zone 3 of the banknote 1 is accomplished, for example, by laying the two zones 2 and 3 one over another.

In a first embodiment, the window 2 in FIG. 1 is provided with a lenticular screen that serves as a verification element. The orientation of the lenticular screen in the zone of the window 2 and the correspondingly printed screen, which serves as a security feature in zone 3 of the banknote 1, must be co-ordinated in such a way that the required effects become visible when zones 2 and 3 are brought to overlap each other, for example by folding.

The printed screen structures serving as the security feature in zone 3 can be created with any type of printing technique that is applied in security printing, preferably the simultaneous-offset method (Letterset) because of the high resolution required.

Figure 4:
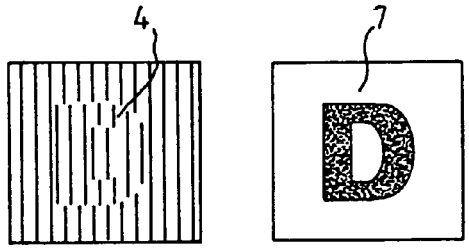
FIG. 4 is the schematic representation of the creation of screen structures.

FIG. 4 shows a simple example of the creation of screen structures in the form of the letter "D." By superimposing the lens screen in window 2 with the line screen 4 in zone 3, a clear image 7 of the letter "D" appears to the observer.

Also, printed line structures in combination with embossments, which show so-called tilt effects (DE 23 34 702), and which are preferably created using the intaglio process, can be made visible by suitably superimposing zones 2 and 3 (FIG. 1) of the banknote 1, whereby zone 2 must have the lens screen to enhance the tilt effect.

The lenticular screens preferably consist of equal-type cylindrical lenses, which are arranged parallel to each other, preferably at the same distance apart (e.g. 200 μm).

These cylindrical lenses can be introduced into a transparent material, e.g. PVC films, in several different ways, e.g. by casting a film on a belt with a negatively formed profile or by extruding lens screens by way of specially formed injection nozzles, e.g. wide-slit nozzles.

The cylindrical lenses can also be produced by impressing with a suitable mould, or by rolling out films between rollers that have a corresponding negative profile.

Gradient-index lenses can be made out of bleached silver halide layers or photo-polymers.

In a second embodiment example according to FIG. 1, the verification element in window 2 of banknote 1 is formed by Fresnel lenses or similar magnifying optical structures that facilitate the recognition of very small type or graphical elements in zone 3 of document 1 when zones 2 and 3 are suitably laid over one another. Here the very minimal thickness of the Fresnel lenses together with the good magnification of the lens, e.g. 5 to 10-fold, is an advantage for integration into the substrate materials.

According to a third embodiment, the verification element in window 2 of the banknote 1 in FIG. 1 is formed by fine line structures, which are also formed on a part of document 1 in zone 3. When the corresponding zones 2 and 3 of document 1 are overlapped, so-called moire structures are generated. Examples of moire-generating patterns are described in DE 28 19 640, DE 23 24 702, DE 26 03 558, DE 36 02 563.

The verification element in window 2 may consist of a printed line or dot screen for a visual coding/decoding method for a banknote 1. In addition to printing fine dots and/or lines, it is also possible to punch zone 2 (the window) of the document 1 or to perforate it, preferably by means of laser perforation, so that by suitably superimposing zones 2 and 3 of the banknote 1, e.g. by folding, a moiré pattern is produced. Zone 3 of the banknote 1 may consist of a transparent material with printed lines/screen, an opaque material with a printed line/screen or a zone with a suitable perforation, preferably a laser perforation.

In a fourth embodiment, a polarizing filter is integrated on/in a preferably transparent film material as a verification element in zone 2, e.g. of a banknote 1, in combination with a further similarly designed polarizing filter in zone 3. The polarizing filter in zone 3 is preferably designed perpendicular or parallel to the polarizing filter in zone 2 and serves as an analyser, so that suitable overlapping of zones 2 and 3 of the banknote 1 and rotation of the overlapping zones 2 and 3 against each other will cause the optical transparency (bright/dark) to alternate or change.

In a further embodiment, an additional dichroic (double refracting), graphically structured layer is applied, e.g. by printing, sputtering, casting or such like, so that suitable overlapping of zones 2 and 3 of the banknote 1 and rotation of the overlapping zones 2 and 3 against each other will cause a graphic element, e.g. a letter, to become visible.

A further embodiment is achieved when one of the two polarisation filters in zones 2, 3 is replaced with a reflecting layer, whereby an additional dichroic, graphically structured layer is applied to this reflecting layer. Suitable overlapping of zones 2 and 3 of the banknote 1 and rotation of the overlapping zones 2 and 3 against each other cause a graphic element, e.g. a letter, to become visible.

A further embodiment provides that one of the two polarisation filters is replaced with a reflecting layer, whereby an additional dichroic, graphically structured layer is applied to this reflecting layer. This double-refracting transparent layer can preferably be in the form of a liquid-crystal-containing film. Suitable overlapping of zones 2 and 3 of the banknote 1, e.g. by folding, then rotating the overlapping zones relative to one another causes a graphic element, e.g. a letter, to become visible.

For many verification effects it is desirable to be able to position two different verification elements over the security feature quickly and easily. This often eases the perception of changes in the case of movement-effects or colour-switching effects. It facilitates verification in cases where a rotation of the verification element with respect to the security feature is necessary. With a single verification window 2, such a rotation would be very impracticable. To solve these problems, it is proposed that the verification window 2 be divided into two adjacent analyser areas (FIG. 2, 2*a* through 2*d*) or that two adjacent windows 2 (FIG. 3) be arranged with different verification elements.

Figure 2:
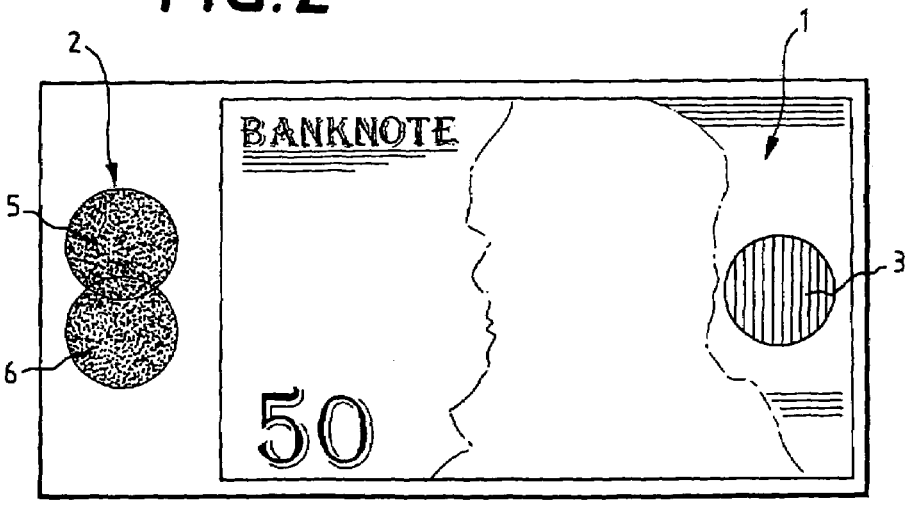
FIG. 2 is the schematic representation of an arrangement with a window having two zones on the banknote and serving as the verification element.
Figure 2A:
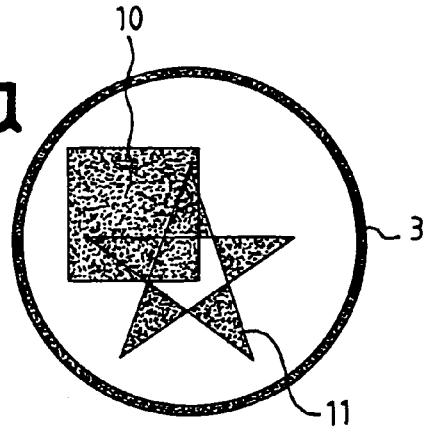
FIG. 2*a* is the schematic representation of an arrangement of one window with two zones according to FIG. 2, for forming a "Vectograph,"
Figure 2A:
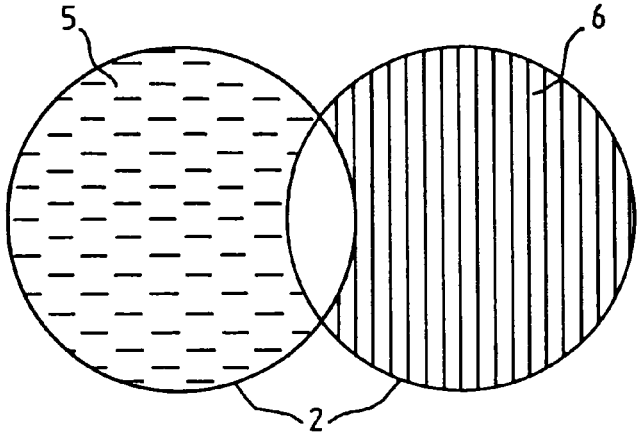
Figure 2C:
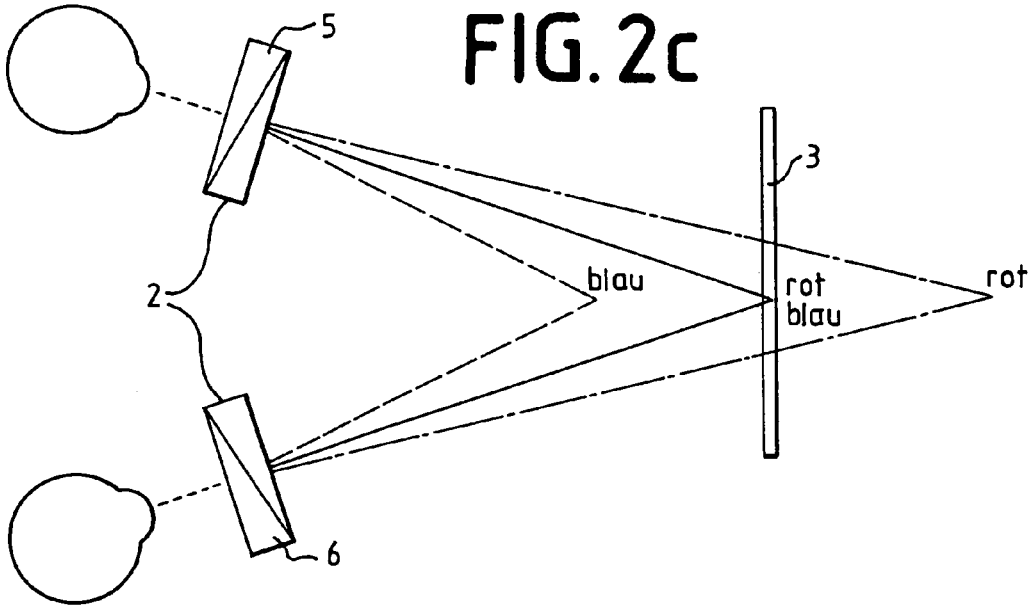
FIG. 2*c* is the schematic representation of an arrangement of one window with two zones according to FIG. 2, for forming a chromastereoscopic image.

FIG. 2*c* shows an embodiment of a verification window 2. At least two clear analyser zones 5, 6 are arranged adjacently to serve as verification elements on the banknote 1. The analyser zones 5, 6 are preferably holographic prisms, if possible embodied as superchromatic prisms, for a so-called chromastereoscopic image. Preferably the prisms are embodied as gradient-index prisms in the form of thin film materials.

Figure 2B:
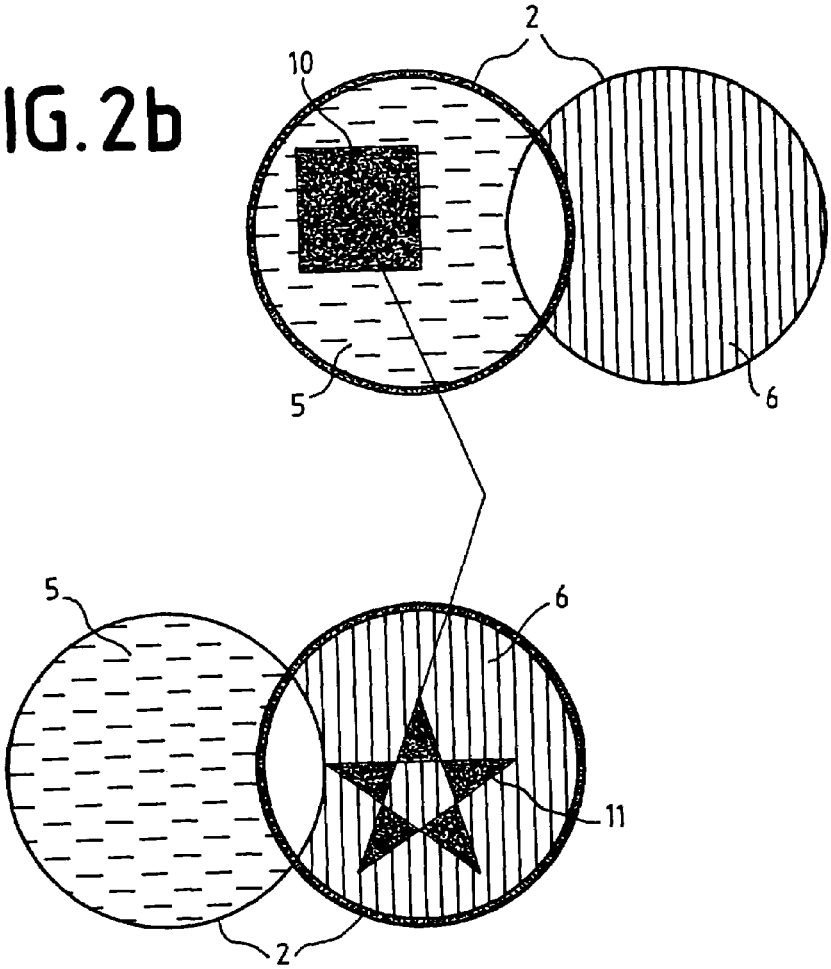
FIG. 2*b* is the schematic representation of an arrangement of one window with two zones according to FIG. 2, for forming different patterns.

An embodiment according to FIG. 2*a* provides that at least two adjacently arranged clear analyser zones 5, 6 in a window 2 are embodied as a so-called "Vectograph". A Vectograph consists of two polyvinyl-alcohol films, which form linear polarization filters when they are printed with iodine paints. The two films are arranged in such a way that when the front side contacts the iodine paint vertical polarization results, and when the rear side contacts the iodine paint horizontal polarization results (FIG. 2*a*, 2*b*). Iodine paint is used to print a selected first pattern, for example a square 10 (FIG. 2*a*, 2*b*), on the front side, and a selected second pattern, for example a star 11 (FIG. 2*a*, 2*b*), on the rear side. When the two superimposed films are viewed with a linear analyser (window 2, zone 5 in FIG. 2*a*, 2*b*), the first pattern (square 10) becomes visible when the analyser is oriented horizontally (zone 5), and the second pattern (star 11) becomes visible when the analyser is oriented vertically (zone 6). In the same manner is also possible to implement colour changes.

A verification window 2 divided in this manner with analyser zones 5, 6 makes it unnecessary to have to rotate the window 2; the window 2 only needs to be shifted.

Figure 2D:
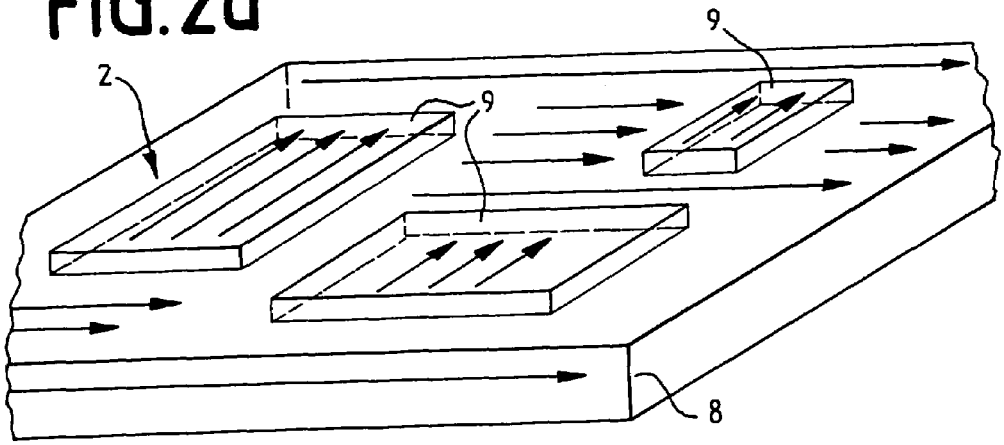
FIG. 2*d* is the schematic representation of an arrangement of one window with two zones according to FIG. 2, for forming "half-wave" zones.

Similarly formed zones 5, 6 can be designed to achieve a contrastive change from transmitting to opaque. Such structures can be implemented by applying to a linear polarizing film 8 (FIG. 2*d*) so-called "half-wave" zones 9 (phase plates with a phase shift of 1800 between ordinary and extraordinary rays), for example by means of suitably oriented film materials of the correct thickness (FIG. 2*d*). The polarization direction is rotated 90° in these zones. This effect is particularly impressive with area-filling patterns. Similarly formed build-ups serve to implement a clearly discernible colour switchover based on the "colour shutter" principle.

In a further embodiment of the verification element(s) in window 2 of the banknote 1, interference colour filters, generally transparent refraction structures and multilayer systems can be used.

The interference colour filters are formed in/on a preferably transparent film material or they consist of this material. The filters are integrated for example on a banknote 1 in zone 2 in combination with a coloured graphical element in zone 3. When zones 2, 3 of the banknote 1 are suitably overlapped, a certain spectral range in the graphic element, for example a character, is blanked out by zone 2 or allowed to pass through, so that a colour impression is perceived that differs from the original colour.

For the interference/colour filters, it is possible to use both coloured transparent materials, and transparent materials with colours vacuum-metallised/sputtered or printed onto them.

Figure 3:
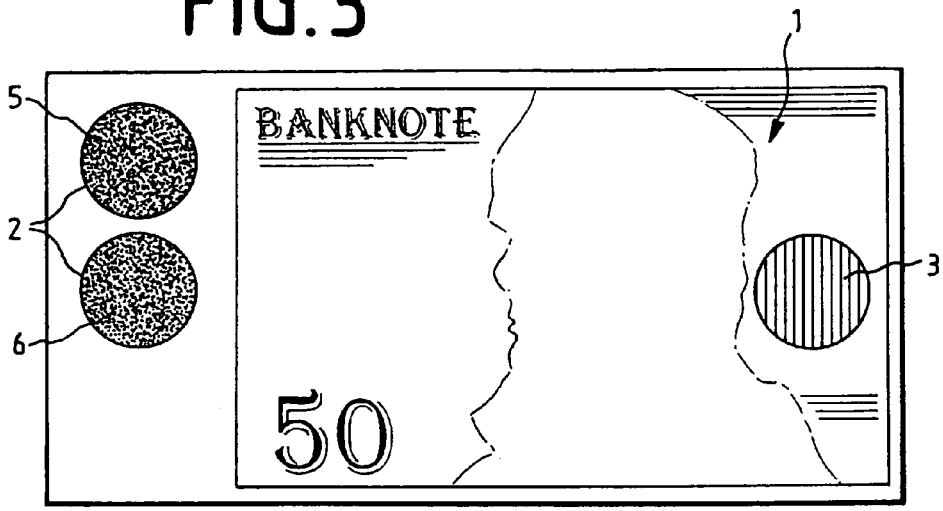
FIG. 3 is the schematic representation of an arrangement of two adjacent windows with different verification elements.

In a further embodiment, at least two clear analyser zones 5, 6 are arranged adjacently according to the representation shown in FIGS. 2 and 3. These zones 5, 6 may be formed by at least two colour filters for viewing so-called anaglyphs (stereo images). The anaglyphs are located in zone 3 of the banknote 1. When zones 5, 6 and 3 are placed over one another at a certain distance from each other, a stereoscopic-impression is created.

Figure 5:
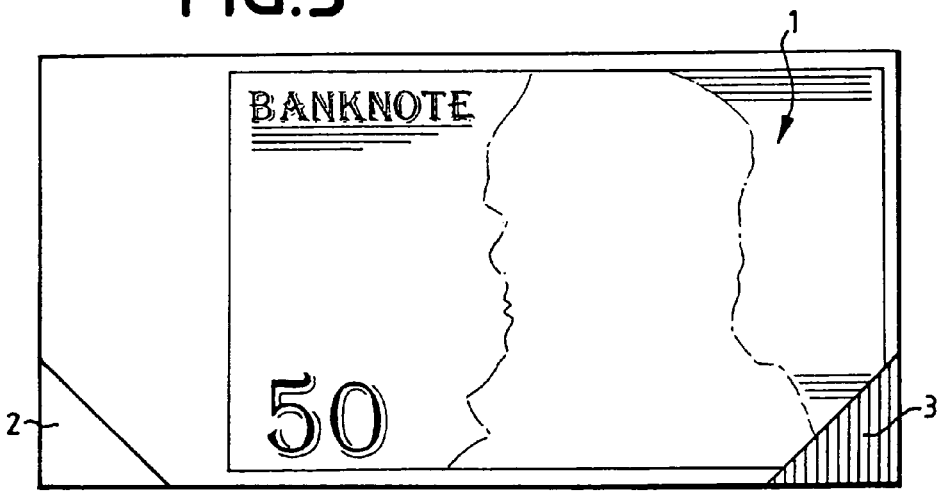
FIG. 5 is the schematic representation of a banknote with windows in one corner.

All the windows can be embodied in any desired form, preferably in a form that is best suited to the respective selected verification element; thus the embodiment can be thread-like or, as shown in FIG. 5, triangular in shape.

The windows can be formed at any positions on the document, including on a corner of the document, as shown for example in FIG. 5; the requirement is only that it must be possible to bring the security feature and the verification element for verifying the security feature together in such a way that they have a functional interrelation, for example by folding, twisting, or superimposing one or more documents.

Superposition can be accomplished by direct contact or, in some cases, with a gap between the security feature and the verification element.

The invention claimed is:

1. Security document and/or value document comprising a banknote with security features and with a verification element for verifying the security feature, wherein at least one verification element and at least one security feature to be verified by this verification element are integrated in the document at different positions, whereby the verification element and the security feature are only superimposed by folding when verification takes place, wherein at least two verification elements are formed by adjacent analyzer zones in one window or in at least two adjacent windows.

2. Security document and/or value document according to claim 1, wherein the analyzer zones are subdivided into a holographic zone and a non-filtering zone.

3. Security document and/or value document according to claim 1, wherein the analyzer zones are embodied as two filter zones for viewing anaglyphs or stereo images.

4. Security document and/or value document according to claim 1, wherein the analyzer zones include prisms for viewing a chromastereoscopic image.

5. Security document and/or value document according to claim 1, wherein the analyzer zones include polarizers for viewing polarization stereo images.

6. Security document and/or value document according to claim 1, wherein the analyzer zones form a Vectograph.

7. Security document and/or value document according to claim 4, wherein the analyzer zones are holographic prisms or gradient index prisms.

8. Security document and/or value document according to claim 1, wherein the filter zones are interference filters, color filters, or holographic filters.

9. Security document and/or value document with security features and with a verification element for verifying the security feature, wherein at least one verification element and at least one security feature to be verified by this verification element are integrated in the document at different positions, whereby the verification element and the security feature are only superimposed when verification takes place, wherein at least two verification elements are formed by adjacent analyzer zones in one window or in at least two adjacent windows, and wherein the document comprises a passport having one page incorporating the analyzer zones and another page of the passport has the security feature.

10. Security document and/or value document according to claim 9, wherein the analyzer zones are subdivided into a holographic zone and a non-filtering zone.

11. Security document and/or value document according to claim 9, wherein the analyzer zones are embodied as two filter zones for viewing anaglyphs or stereo images.

12. Security document and/or value document according to claim 9, wherein the analyzer zones include prisms for viewing a chromastereoscopic image.

13. Security document and/or value document according to claim 10, wherein the analyzer zones are holographic prisms or gradient index prisms.

14. Security document and/or value document according to claim 9, wherein the analyzer zones include polarizers for viewing polarization stereo images.

15. Security document and/or value document according to claim 9, wherein the analyzer zones form a Vectograph.

16. Security document and/or value document according to claim 1, wherein the filter zones are interference filters, color filters, or holographic filters.

17. Security document and/or value document with security features and with a verification element for verifying the security feature, wherein at least one verification element and at least one security feature to be verified by this verification element are integrated in the document at different positions, whereby the verification element and the security feature are only superimposed by folding when verification takes place, wherein at least two verification elements are formed by adjacent analyzer zones in one window or in at least two adjacent windows, and wherein the analyzer zones are subdivided into a holographic zone and a non-filtering zone.

18. Security document and/or value document with security features and with a verification element for verifying the security feature, wherein at least one verification element and at least one security feature to be verified by this verification element are integrated in the document at different positions, whereby the verification element and the security feature are only superimposed by folding when verification takes place, wherein at least two verification elements are formed by adjacent analyzer zones in one window or in at least two adjacent windows, and wherein the analyzer zones include prisms for viewing a chromastereoscopic image.

19. Security document and/or value document according to claim 18, wherein the analyzer zones are holographic prisms or gradient index prisms.

20. Security document and/or value document comprising a banknote with security features and with a verification element for verifying the security feature, wherein at least one verification element and at least one security feature to be verified by this verification element are integrated in the document at different positions, whereby the verification element and the security feature are only superimposed by folding when verification takes place, wherein at least two verification elements are formed by adjacent analyzer zones in one window or in at least two adjacent windows, and wherein the analyzer zones include polarizers for viewing polarization stereo images.

21. Security document and/or value document with security features and with a verification element for verifying the security feature, wherein at least one verification element and at least one security feature to be verified by this verification element are integrated in the document at different positions, whereby the verification element and the security feature are only superimposed by folding when verification takes place, wherein at least two verification elements are formed by adjacent analyzer zones in one window or in at least two adjacent windows, and wherein the analyzer zones form a Vectograph.

22. Security document and/or value document with security features and with a verification element for verifying the security feature, wherein at least one verification element and at least one security feature to be verified by this verification element are integrated in the document at different positions, whereby the verification element and the security feature are only superimposed by folding when verification takes place, wherein at least two verification elements are formed by adjacent analyzer zones in one window or in at least two adjacent windows, and wherein the filter zones are interference filters or holographic filters.

23. Security document and/or value document with at least one security feature and with a verification element for verifying the security feature, wherein, at least one verification element and at least one security feature to be verified by this verification element are integrated in the document at different positions, whereby the verification element and the security feature are only superimposed when verification takes place, wherein the verification element is formed by at least one window, which contains as a verification means a polarisation filter, an interference filter, a holographic filter or a hologram and the security feature is formed as a coloured graphic element.

24. Security document and/or value document according to claim 23, wherein at least one security feature is embodied on the front side and/or rear side.

25. Security document and/or value document according to claim 23, wherein the verification element is embodied as a strip on one of the edges of the document.

26. Security document and/or value document according to claim 23, wherein one corner of the document is embodied as a verification element.

27. Security document and/or value document according to claim 23, wherein the verification element, is formed by at least one window providing at least two analyzer zones with verification elements.

28. Security document and/or value document according to claim 23, wherein at least one window is embodied as a holographic filter that reflects a narrow spectral range.

29. Security document and/or value document according to claim 27, wherein the verification window is adjacently subdivided into a holographic zone and a non-filtering zone.

30. Security document and/or value document according to claim 27, wherein the verification window is adjacently embodied as two filter zones for viewing anaglyphs, or stereo images.

31. Security document and/or value document according to claim 27, wherein the verification window is adjacently embodied as analyzer zones with prisms for viewing a chromastereoscopic image.

32. Security document and/or value document according to claim 27, wherein the verification window is adjacently embodied as two analyzer zones with polarisers for viewing polarisation stereo images.

33. Security document and/or value document according to claim 27, wherein the zones of the verification window form a Vectograph.

34. Security document and/or value document according to claim 23, including at least two verification windows each forming an analyzer zone with a verification element.

35. Security document and/or value document according to claim 23, wherein the verification element and the security feature of the document are, for the purpose of verifying the security feature, brought into position over each other by folding the document, in which effective position they can be machine-recognised.

36. Security document andior value document according to claim 23, wherein the verification element of a document and the security feature of another document are brought into position over each other for the purpose of verifying the security feature.

37. Security document and/or value document according to claim 23, wherein when the verification element and the security feature are superimposed a colour impression of the graphic element is perceived that differs from the original colour.

38. Security document and/or value document according to claim 23, wherein when the verification element and the security feature are superimposed, part of the coloured graphic element, such as a letter, becomes visible.

39. Security document and/or value document according to claim 23, wherein the verification means is a filter that transmits or blocks out a certain spectral range.

40. Security document and/or value document according to claim 23, wherein the verification means is an interference filter.

41. Security document and/or value document according to claim 40, wherein the interference filter comprises a transparent diffraction structure.

42. Security document and/or value document according to claim 40, wherein the interference filter is a multilayer system.

43. Security document and/or value document according to claim 23, wherein the verification means is a polarisation filter and the coloured graphic element comprises a diebroic graphically structured layer.

44. Security document and/or value document according to claim 43, wherein when the polarisation filter and the dichroic graphically structured layer are superimposed, a graphic element becomes visible.

45. Security document and/or value document according to claim 43, wherein the dichroic graphically structured layer is applied to a reflective layer.

46. Security document and/or value document according to claim 43, wherein the dichroic graphically structured layer is provided in a liquid-crystal-containing film.

47. Security document and/or value document according to claim 43, wherein the dichroic graphically structured layer is applied by printing, sputtering or casting

48. Security document and/or value document according to claim 28, wherein when the verification element and the security feature are superimposed, a compound colour appears in a different colour.

49. Security document and/or value document according to claim 28, wherein when the verification element and the security feature are superimposed, a pure spectral colour disappears.

50. Security document and/or value document according to claim 23, wherein the document comprises a passport having one page incorporating the verification element formed by at least one window and another page having the security feature.

51. Security document and/or value document according to claim 23, wherein the document comprises a banknote.

52. Security document and/or value document with at least one security feature and with a verification element for verifying the security feature, wherein at least one verification element and at least one security feature to be verified by this verification element are integrated in the document at different positions, whereby the verification element and the security feature are only superimposed when vcrification takes place, wherein at least one of the verification element and the security feature is formed by a hologram or a holographic filter.

53. Security document and/or value document according to claim 52, wherein the verification element is formed by at least one window, which contains as a verification means a hologram or a holographic filter.

54. Security document and/or value document according to claim 53, wherein said at least one window containing the verification means is embodied as a holographic filter that reflects a narrow spectral range.

55. Security document and/or value document according to claim 52, wherein when the verification element and the security feature are superimposed, a compound colour appears in a different colour.

56. Security document and/or value document according to claim 52, wherein when the verification element and the security feature are superimposed, a pure spectral colour disappears.

57. Security document and/or value document, according to claim 52, wherein the verification element is formed by at least one window providing at least two analyzer zones with verification elements.

58. Security document and/or value document according to claim 57, wherein the analyzer zones are adjacently subdivided into a holographic zone and a non-filtering zone

59. Security document and/or value document according to claim 57, wherein the verification window is adjacently embodied as analyzer zones with holographic prisms for viewing a chromastereoscopic image.

60. Security document and/or value document according to claim 57, including at least two verification windows each forming an analyzer zone with a verification element.

61. Security document and/or value document according to claim 57, wherein the analyzer zones with the verification elements are adjacently embodied as two holographic filters for viewing anaglyphs, or stereo images.

62. Security document and/or value document according to claim 52, wherein the verification element and the security feature of the document are, for the purpose of verifying the security feature, brought into position over each other by folding the document.

63. Security document and/or value document according to claim 52, wherein the verification element of a document and the security feature of another document are brought into position over each other for the purpose of verifying the security feature.

64. Security document and/or value document with security features and with a verification element for verifying the security feature, wherein at least one verification element and at least one security feature to be verified by this verification element are integrated in the document at different positions, whereby the verification element and the security feature are only superimposed when verification takes place, wherein the verification element is formed as a at least one lens, a mask for a parallax- barrier display or a perforated zone.

65. Security document and/or value document according to claim 64, wherein the verification element comprises a lenticular screen consisting of cylindrical lenses arranged parallel to each other

66. Security document and/or value document according to claim 65, wherein the cylindrical lenses are uniform and at the same distance apart.

67. Security document and/or value document according to claim 64, wherein the verification element comprises a line screen or dot screen, and the security feature comprises lines or dots.

68. Security document and/or value document according to claim 67, wherein the lines or dots of the security feature are printed.

69. Security document and/or value document according to claim 67, wherein the lines or dots of the security feature are perforations.

70. Security document and/or value document according to claim 67, wherein the lines or dots of the verification element are laser perforations.

71. Security document and/or value document according to claim 67, wherein the lines or dots of the security feature are laser perforations.

72. Security document and/or value document according to claim 64, wherein the document comprises a banknote.

73. Security document and/or value document according to claim 64, wherein the document comprises a passport having one page incorporating the at least one verification element and another page having the security feature.

* * * * *

UNITED STATES PATENT AND TRADEMARK OFFICE

CERTIFICATE OF CORRECTION

PATENT NO. : 7,488,002 B2
APPLICATION NO. : 10/740751
DATED : February 10, 2009
INVENTOR(S) : B. H. Ahlers et al.

It is certified that error appears in the above-identified patent and that said Letters Patent is hereby corrected as shown below:

| COLUMN | LINE | ERROR |
|---|---|---|
| (75) Pg. 1, col. 1 | Inventors | "**Armim Franz-Burgholtz**" should read --**Arnim Franz-Burgholtz**-- |
| (75) Pg. 1, col. 1 | Inventors | insert in appropriate order --**Bertel Podoll**, Berlin (DE)-- |
| (73) Pg. 1, col. 1 | Assignee | "**Securency Pty Limited**" should read --**Securency International Pty Limited**-- |
| 11 (Claim 43, | 3 line 3) | "diebroic" should read --dichroic-- |
| 12 (Claim 64, | 33 line 9) | "as a at" should read --as at-- |
| 12 (Claim 64, | 34 line 10) | "parallax- barrier" should read --parallax-barrier-- |

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,488,002 B2
APPLICATION NO. : 10/740751
DATED : February 10, 2009
INVENTOR(S) : B. H. Ahlers et al.

It is certified that error appears in the above-identified patent and that said Letters Patent is hereby corrected as shown below:

| COLUMN | LINE | ERROR |
|---|---|---|
| (73)<br>Pg. 1, col. 1 | Assignee | "**Securency Pty Limited**" should read<br>**--Securency International Pty Limited--** |

Signed and Sealed this

Twenty-second Day of June, 2010

David J. Kappos

David J. Kappos
*Director of the United States Patent and Trademark Office*